US005820042A

United States Patent [19]

Robison

[11] Patent Number: 5,820,042

[45] Date of Patent: Oct. 13, 1998

[54] WOOD CHIPPER ROTOR HEAD KNIFE HOLDER AND KNIFE ASSEMBLY

[75] Inventor: Milan W. Robison, Weidman, Mich.

[73] Assignee: Wood Technology, Inc., Winn, Mich.

[21] Appl. No.: 877,232

[22] Filed: Jun. 17, 1997

[51] Int. Cl.[6] ..... B02C 18/18

[52] U.S. Cl. ..... 241/92; 29/402.08; 29/428; 144/176; 241/298

[58] Field of Search ..... 29/402.03, 402.08, 29/426.1, 428, 464, 465; 144/162.1, 176; 241/92, 296, 298

[56] References Cited

U.S. PATENT DOCUMENTS

| | | | |
|---|---|---|---|
| 3,542,302 | 11/1970 | Salzmann, Jr. . | |
| 3,661,333 | 5/1972 | Smith . | |
| 4,057,192 | 11/1977 | Smith . | |
| 4,078,590 | 3/1978 | Smith . | |
| 4,669,516 | 6/1987 | Carpenter et al. . | |
| 4,685,497 | 8/1987 | Mierau et al. . | |
| 4,694,995 | 9/1987 | Holmberg et al. . | |
| 4,771,718 | 9/1988 | Carpenter et al. . | |
| 4,850,408 | 7/1989 | Carpenter et al. . | |
| 4,887,772 | 12/1989 | Robinson et al. | 241/298 |
| 4,997,018 | 3/1991 | Carpenter et al. . | |
| 5,271,440 | 12/1993 | Bradstreet, Jr. et al. . | |
| 5,271,442 | 12/1993 | Carpenter et al. . | |
| 5,274,899 | 1/1994 | Sentagnes et al. . | |
| 5,348,064 | 9/1994 | Nettles et al. . | |
| 5,409,047 | 4/1995 | Jorgensen . | |
| 5,439,039 | 8/1995 | Bradstreet, Jr. et al. . | |
| 5,444,904 | 8/1995 | Kokko | 241/298 |
| 5,469,902 | 11/1995 | Sharp et al. . | |
| 5,511,597 | 4/1996 | Shantie et al. . | |
| 5,660,218 | 8/1997 | Jowkka | 144/176 |

FOREIGN PATENT DOCUMENTS

| | | | |
|---|---|---|---|
| 3722682 | 1/1989 | Germany | 144/176 |

*Primary Examiner*—Mark Rosenbaum
*Attorney, Agent, or Firm*—Reising, Ethington, Learman & McCulloch, PLLC

[57] ABSTRACT

A wood chipper knife holder assembly for a power driven rotor head has at least one opening in its wood confronting surface for the knife holder assembly which includes a mount block. A counter-knife receiving surface opposite the wood confronting surface of the rotor head is provided on the mount block for a counter-knife and a reversible knife blade with cutting surfaces along opposite transverse edges is received on the counter-knife. A clamp plate secures to clamp the knife in a projecting cutting position. The counter-knife has at least one pair of spaced apart pin openings and the knife blade has at least one pair of complemental pin openings, and pins are received in the knife blade openings and counter-knife pin openings to permit 180° relocation of the knife.

9 Claims, 2 Drawing Sheets

WOOD CHIPPER ROTOR HEAD KNIFE HOLDER AND KNIFE ASSEMBLY

BACKGROUND OF THE INVENTION

The present invention relates to improvements in chipper knife and counter knife assemblies in knife holders which are housed in openings provided in rotor heads such as chipper discs. Typically, apparatus of the character to be described is utilized in circumferentially spaced relation on the chipper disc of a chipping machine which chips wood into chips. Such chippers are used to chip a wide variety of wood, ranging from whole logs and trees to saw mill residual wood and recyclable wood resulting from the demolition of old buildings, for example.

The present invention is concerned with the utilization of relatively low cost, disposable, reversible knives, clamped to a counter-knife which is secured within a knife holder assembly. Typically, the chipping disc employed has a plurality of such knives and knife holders, as disclosed, for example, in U.S. Pat. Nos. 3,661,333; 4,057,192; and 4,078,590.

While reversible knife blades are well known, none of the known systems have overcome all of the problems incident to their use, and none compositely have all of the advantages of the system to be disclosed herein.

SUMMARY OF THE INVENTION

The invention is concerned with the employment of a double-edged reversible knife which is removably mounted on the counter-knife by pins which project into pin openings in the counter-knife. A clamp plate is in engagement with the outer knife blade surface. With the present system, one individual can change the knives from the wood confronting front of the disc by simply backing off the clamp plate, lifting the knife plate with its pins off the counter-knife, turning it end for end to reengage it via its pins, and then resecuring the clamp plate. When the counter knife as well as the knife blade is worn, it is a relatively simple matter to further back off the fasteners holding the counter knife in the knife holder assembly as well, and reverse the counter-knife before replacing and reinstalling the knife blade via alternative pin openings in the reversed counter-knife.

One of the prime objects of the present invention is to provide a knife system permitting changing of the knives from the front of the disc in a much faster and safer manner.

A further object of the invention is to provide a system effecting labor savings for the customer in the replacement of the throwaway knives and counter-knives as they become unduly worn.

Another object of the invention is to very efficiently mount the lift-off knife blades in a manner to prevent them from slipping, without fixing them in position with fasteners which need to be backed off before the change can be effected.

Still a further object of the invention is to provide a reliable knife and counter-knife blade system of a simple nature which is economical to install and to use, and which can be easily retrofitted in chippers which are already in the field.

Other objects and advantages of the invention will become apparent with reference to the accompanying drawings and the accompanying descriptive matter.

THE DRAWINGS

In the drawings, FIG. 1 is a schematic perspective elevational view of a typical rotor head disc;

FIG. 2 is a considerably enlarged fragmentary transverse sectional view taken on the line 2—2 of FIG. 1; and FIG. 3 is an exploded view illustrating the knife holder assembly componentry.

DETAILED DESCRIPTION

Figure 1:
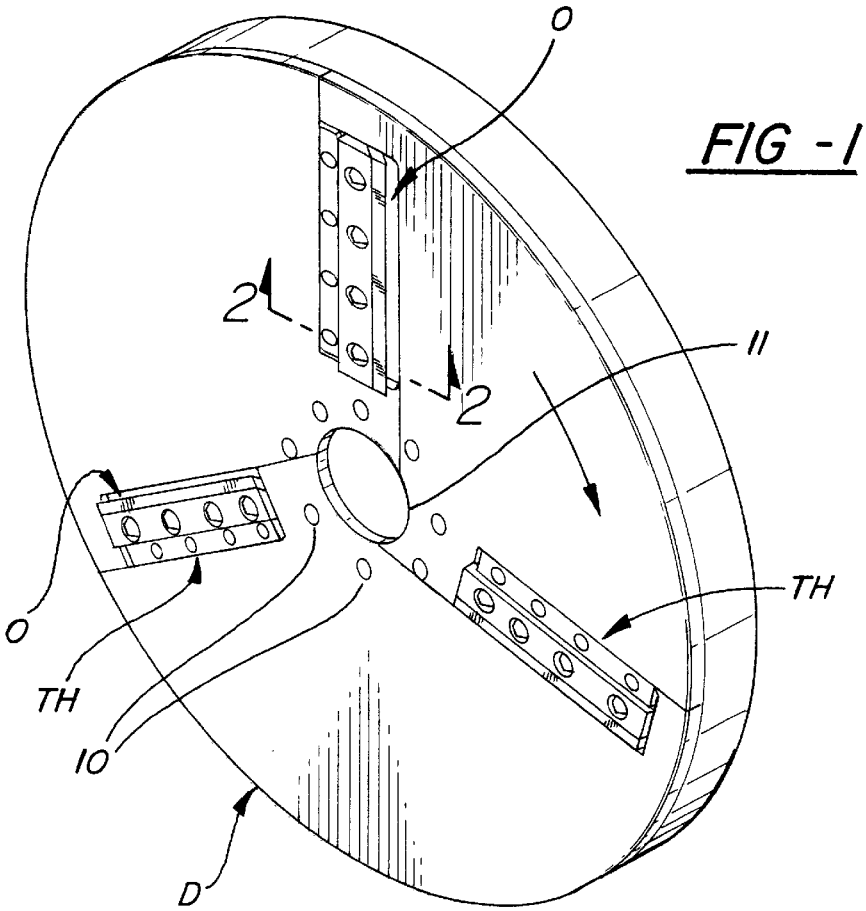
Figure 2:
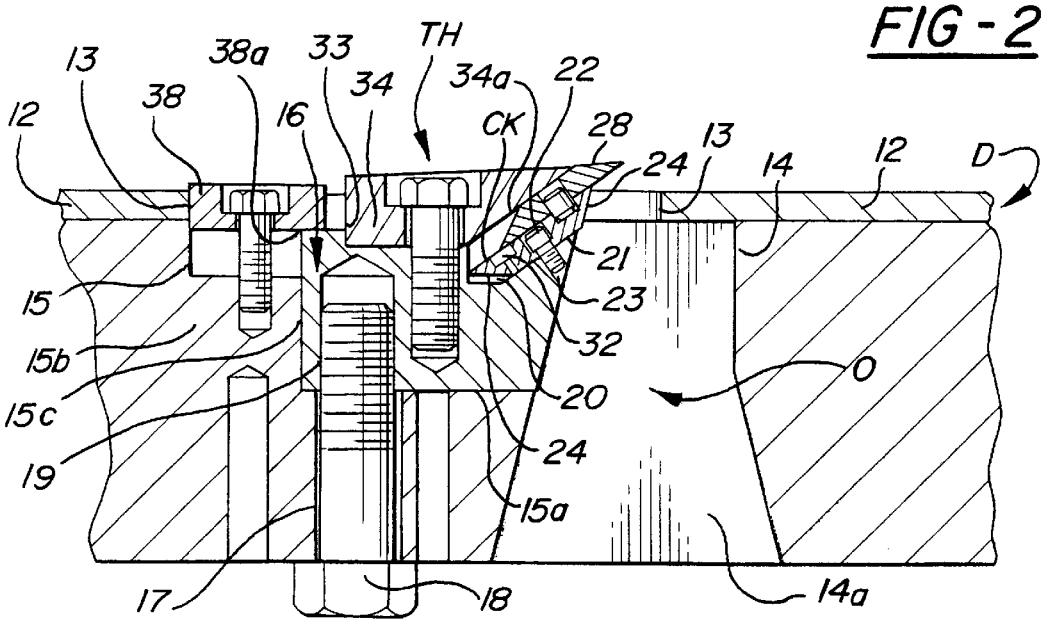

Referring now more particularly to the accompanying drawings, and in the first instance to FIGS. 1 and 2 particularly, it is to be understood that the rotor head or chipper disc, generally indicated at D, is fixed to the flange of a motor driven drive shaft (not shown) in the usual manner, such as by extending bolts or other fasteners through the openings 10 which are provided through the disc D. Provided in the disc D, are a trio of circumferentially spaced openings, generally designated O, which are internally configured in the manner indicated in FIG. 2 to each fixedly mount a tool holder assembly, generally designated TH, which presently will be described in detail. The disc D, it will be noted, has a central opening 11 which snugly receives the drive shaft and the wood confronting surface of the disc D may be provided by wear resisting segment covers 12 which are formed with openings 13 generally conforming compositely to the openings O.

Figure 3:
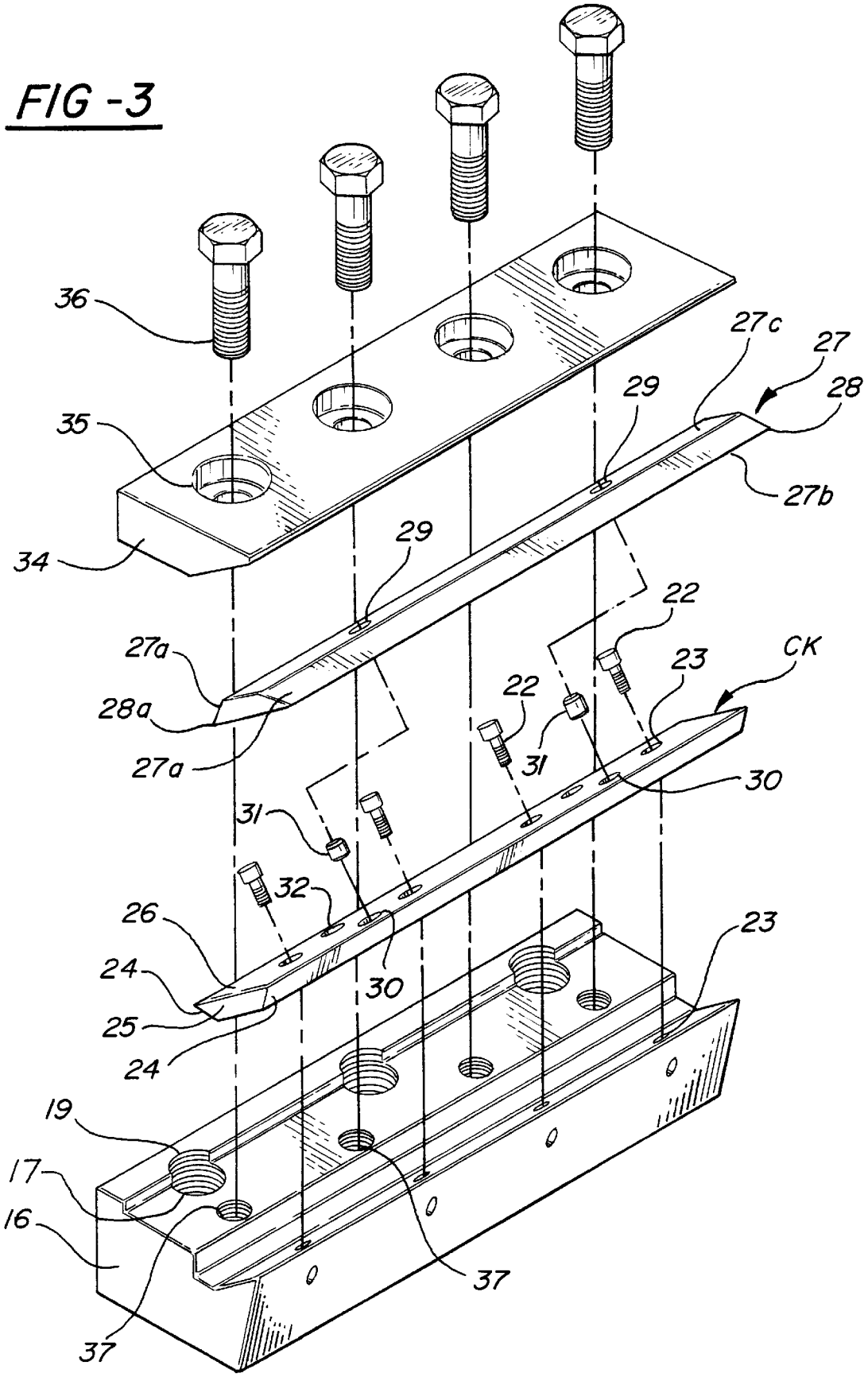

It will be observed that each opening O has a generally radially extending leading marginal wall 14 which is circumferentially spaced from the tool holder assembly TH sufficiently to form a chip expressing passage 14*a* through which the chips cut pass from the wood confronting front of the disc D to the rear of the disc D in the usual manner. The opening O further has a trailing stepped wall 15 which includes an inner shouldered surface 15*a* and an outer shouldered surface 15*b*. A wall 15*c* connects the shouldered surfaces 15*a* and 15*b* and, together, the walls 15*a* and 15*c* provide a seat for a mount block, generally designated 16, which is configured in the manner more specifically illustrated in FIG. 3. Bolt openings 17 can be provided, as shown in FIGS. 2 and 3, for bolts 18 which extend into threaded openings 19 in the mount block 16 to releasibly fix the tool holder assembly in place. It will be seen that the inclined front face of mount block 16 is cut away as at 20, and provides a counter-knife receiving surface 21 at an acute angle relative to the direction of rotation of the cutter disc D and its frontal wood confronting surface. Received on the surface 21 is a counter-knife, generally designated CK, which has a series of fastener or screw openings 22 for cap screws which extend into threaded openings 23 to releasably secure the counter-knife CK in position. The opposed edges of the counter-knife are acutely oppositely beveled as at 24 in a manner which permits them to be turned 180°, or end for end, and the cutaway portion 20 is configured to accommodate this, as shown in FIG. 2. The inner surface of the blade-like counter-knife CK is flatted to conform to the receiving surface 21 and its outer surface 26 is parallelly flatted to receive the cutting knife or blade, generally identified by the numeral 27.

As will be seen, the cutting knife 27, which has a leading cutting edge 28 in FIG. 2, has acutely oppositely beveled portions 27*a* so that the knife can be turned 180° or end for end, to present a fresh cutting edge 28*a* to the wood confronting side of the disc D at the appropriate time. The flat inner face of the knife 27 may be identified as 27*b* and the parallel outer surface of the knife 27 is identified by the numeral 27*c*. It will be observed that the knife blade 27 is provided with a pair of cylindrical, through openings 29 which are centrally located in the surface 27*c* along an end to end longitudinal centerline and are equally spaced from the ends of the blade.

The counter-knife CK has a pair of complemental cylindrical pin openings 30 which, when the knife blade 27 and counter knife CK are in the operating position shown in FIG. 2, receive the cylindrical pins 31 carried normally but releasably by knife blade 27. It will be observed that the openings 30 are not longitudinally centrally located but are forwardly, transversely displaced relative to the cutting edge 28 in FIG. 2. Provided in transverse parallelism with the openings 30 are alternative cylindrical pin openings 32 which are equally transversely displaced from a longitudinal centerline taken through counter-knife CK. The disposition of alternative openings 32 is such that they will receive the pins 31 when the position of the counter knife CK is reversed due to wear.

Provided in the mount block 16 is a recess 33 for receiving and seating a knife clamp, generally designated 34, which is provided with counterbored openings 35 for receiving bolts 36 which extend down into threaded openings 37 provided in the mount block 16 to secure the clamp 34 in the position indicated in FIG. 2. The clamp plate 34 has an under-beveled clamp surface 34*a*, which covers the pin openings 29. It will further be observed that a plate 38 is fixed in position as by welding it in position, as at 38*a*, or bolting it, for example, and that the trailing upper corner of mount block 16 is received thereunder.

THE OPERATION

In practice, the chips which are cut by the cutting edge 28 in FIG. 2 move through the openings 13 and O to the rear of disc D in the usual manner. The degree of projection of the knife 27 from the wood confronting surface of the disc D and the counter knife leading edge 24 determines the size of the chips which are produced. It is desirable that uniform size chips be produced, when these chips are to be used in the paper making industry, for example. The present invention therefore contemplates the use of relatively inexpensive blades 27 which, when dulled, are normally reversed end for end. It further contemplates the end for end reversal of the counter-knife 21 when the leading surface 24 of the counter-knife becomes worn. Normally, the knife 27 will wear somewhat more rapidly so that knife changes will need to be effected somewhat more frequently than counter-knife changes. Because of the acute angulation of surface 21, both the counter-knife CK and knife blade can be relatively economically produced, rapidly reversible blade-like components.

In practice, to reverse the knife 27, it is merely necessary to back off the bolts 36 and remove the clamp 34. The pins 31 are more snugly carried with a tighter tolerance in openings 29 than in openings 30 or 32 so the knife 27, carrying pins 31, may simply be lifted off and reversed to present the opposed cutting edge 28*a* to the wood confronting surface, after which the clamp plate 34 may be replaced. If, at the same time, it is desired to reverse the position of the counter-knife blade 21, it is merely necessary to remove the allenhead cap screws 23, once the knife blade 27 is removed, and to then replace the blade 27 such that the pins 31 seat in the other, now leading, openings 32. Then, cap screws 22 may be replaced, the knife blade 27 reversed if necessary, and finally the clamp plate 34 reapplied. Because the mount block surface 21 is acutely angled to be parallel with the counter-knife parallel surfaces, and the inner and outer surfaces of the knife 27, the counter-knife CK can be provided with edges 24 which can be readily interchanged.

The system which has been disclosed and claimed will work very well in chipping whole trees and, of course, if debris is encountered which breaks off an edge 28, the knife blade 27 can be easily reversed in the manner indicated. Basically, all the knives 27 and counter-knives CK are reversible, throw away blades. Some sharpening may be feasible, if it is such as not to affect the size of the chips which are being cut in an unacceptable manner. Also, with the system described, the counter-knife configuration can be varied in terms of the angularity of its leading face 24, or its width to move the face 24 closer to or further from the knife cutting edge 28 or 28*a*, to accommodate to the various wood types to be cut, and the climactic conditions where cutting is taking place.

The disclosed embodiment is representative of a presently preferred form of the invention, but is intended to be illustrative rather than definitive thereof. The invention is defined in the claims.

I claim:

1. In a wood chipper knife holder assembly for a power driven rotor head having at least one opening in its wood confronting surface in which the knife holder assembly is fixedly mounted, the knife holder assembly including a mount block, received within the said rotor head opening, which has an inclined surface acute to and angularly facing the wood confronting surface, the rotor head leaving a chip passage for receiving the chips cut, a counter knife blade received on said inclined surface of the mount block, a reversible knife blade with cutting surfaces along opposed edges received on said counter knife, and a clamp plate secured to clamp the knife in a cutting position in which one of its cutting edges projects beyond the counter-knife and wood confronting surface in cutting position; the improvement wherein:

a. the counter-knife is an endwisely reversible counter-knife having inner and outer surfaces parallel to said mount block inclined surface, the outer surface of the counter-knife having at least a pair of transversely spaced apart alternative pin openings;

b. the knife blade has inner and outer surfaces parallel to said surfaces of the counter-knife, and at least one pin opening; and c. a pin is received in said knife blade opening, and also one of said alternative counter-knife openings with which it aligns, which permits placement of said knife at 180° rotated positions, the said pin being selectively receivable in one of the alternative pin openings in said counter knife which are so spaced as to dispose the other knife edge in a cutting position projecting from the wood confronting surface when the counter-knife is endwisely reversed as well.

2. The assembly of claim 1 wherein the clamp plate has a seat provided in said knife holder and seats therein, and has a beveled surface overlying and bearing on said knife outer surface, there being a fastener extending through said clamp plate to said knife holder mount block to exert a clamping force on said knife.

3. The assembly of claim 1 wherein said counter-knife has counterbores transversely intermediate said pin openings, and fasteners extend therethrough to releasibly anchor said counter-knife to said inclined surface of the mount block.

4. The assembly of claim 1 wherein said counter-knife has a pair of transversely spaced apart pin openings adjacent each of its ends, said knife has a pair of transversely central pin openings in longitudinal alignment, and a pin is received in each of the pin openings in said knife blade and also one of said counter-knife openings at each end of the counter-knife.

5. A method of making a wood chipper knife holder assembly for a power driven rotor head having at least one opening in its wood confronting surface in which the knife holder assembly is fixedly received, and the knife holder assembly includes a mount block received within the said opening and having a counter-knife receiving surface opposite the wood confronting surface, a counter-knife received on said surface of the mount block, a double edged knife blade is received on the counter-knife, and a clamp is secured to clamp the knife blade and hold it in a position in which it projects beyond the wood confronting surface in cutting position, comprising the steps of:

a. providing the counter-knife with at least one pair of spaced apart pin openings and removably mounting it on said counter-knife receiving surface of the mount block;

b. providing the knife blade with pin receiving openings;

c. inserting pins in said knife blade pin openings and extending them into said counter-knife openings to permit 180° relocation of said knife blade with respect to said counter-knife; and securing said clamp plate in a position to overlie and bear on said knife outer surface to exert a clamping force thereon.

6. The method of claim 5 wherein the clamp plate has a seat provided in the mount block and further has a beveled surface for overlying and bearing on the knife blade outer surface, and clamping fasteners to extend through the clamp plate to the mount block and clamp the knife blade in position.

7. The method of claim 5 wherein counterbores are provided in said counter-knife intermediate said pin openings, and extending fasteners therethrough to releasibly anchor said counter-knife to said counter-knife receiving surface of the knife holder assembly.

8. The method of claim 5 wherein the knife blade has a pair of transversely spaced pin openings near its ends and said counter-knife is provided with a pair of pin openings near each of its ends spaced so that the knife blade, upon release of the clamp plate, can simply be lifted off the counter-knife, the counter-knife is then turned end to end, and the knife blade is reinserted with said pins received in a different set of counter-knife openings to expose a new knife edge in cutting position.

9. In a wood chipper knife holder assembly for a power driven rotor head having at least one opening in it wood confronting surface for the knife holder assembly, the knife holder assembly including a mount block to be received within the said rotor head opening, having a counter-knife receiving surface opposite the wood confronting surface of the rotor head, a counter-knife received on the mount block receiving surface, a reversible knife with cutting surfaces along opposite transverse edges received on the counter-knife, and a clamp plate secured to clamp the knife in a cutting position in which one of its cutting edges projects beyond the counter-knife; the improvement wherein:

(a) the counter-knife is removably mounted on the counter knife receiving surface of the mount block and provided with at least one pair of spaced apart pin openings;

(b) the knife blade has at least one pair of pin openings; and (c) pins are received in the knife blade openings and counter-knife pin openings to permit 180° relocation of said knife with respect to said counter-knife.

* * * * *